US005676710A

United States Patent [19]

Chedgy

[11] Patent Number: 5,676,710

[45] Date of Patent: Oct. 14, 1997

[54] COAL PREPARATION SYSTEM

[75] Inventor: David G. Chedgy, McMurray, Pa.

[73] Assignee: CLI International Enterprises, Inc., Pittsburgh, Pa.

[21] Appl. No.: 638,663

[22] Filed: Apr. 29, 1996

[51] Int. Cl.[6] ..... C10L 9/00

[52] U.S. Cl. ..... 44/621; 44/620

[58] Field of Search ..... 44/620, 621

[56] References Cited

U.S. PATENT DOCUMENTS

| | | | |
|---|---|---|---|
| 2,817,441 | 12/1957 | Leeman et al. | 209/211 |
| 3,023,893 | 3/1962 | Zaborowski | 209/18 |
| 4,120,665 | 10/1978 | Kindig et al. | 44/620 |
| 4,304,573 | 12/1981 | Burgess et al. | 44/620 |
| 4,795,037 | 1/1989 | Rich, Jr. | 44/621 |
| 4,854,941 | 8/1989 | Chedgy | 44/626 |
| 4,921,597 | 5/1990 | Lurie | 209/223.2 |
| 5,236,089 | 8/1993 | Smithan et al. | 44/621 |
| 5,277,368 | 1/1994 | Kindig et al. | 44/621 |

*Primary Examiner*—Ellen M. McAvoy

*Attorney, Agent, or Firm*—Alan G. Towner; Walter J. Blenko, Jr.; Eckert Seamans Cherin & Mellott, LLC

[57] ABSTRACT

A coal preparation plant separates a low specific gravity clean coal fraction from a high specific gravity refuse fraction, and separately processes those fractions. Run of mine coal having particle sizes up to about 4 inches is mixed with a slurry of water and magnetizable particles, and is introduced into a heavy media cyclone to separate the high and low specific gravity fractions. The high specific gravity refuse fraction is delivered to a first magnetic separator to extract the magnetizable particles, while the low specific gravity clean coal fraction is delivered to a second magnetic separator to remove the magnetizable particles. The system is highly efficient and has a high processing capacity.

16 Claims, 5 Drawing Sheets

COAL PREPARATION SYSTEM

BACKGROUND OF THE INVENTION

1. Field of the Invention

The present invention relates to a system for preparing coal. More particularly, the invention relates to a coal preparation plant which separates solid material into fractions according to specific gravity.

2. Background Information

The use of heavy media separation is well known in coal preparation. The process involves introducing finely divided particles of high magnetic susceptibility, e.g., magnetite or ferrosilicon, into water to form a slurry, adjusting the amount of magnetite or ferrosilicon so that the slurry has a desired specific gravity and then introducing the mineral into the slurry. Separation may be achieved between those mineral particles which have a specific gravity less than the specific gravity of the slurry and which float across, and those mineral particles which have a higher specific gravity than the slurry which sink. When treating coal, the specific gravity of the magnetite slurry may be adjusted in a range of 1.35 to 1.80, for example. Pieces which have a specific gravity of less than 1.35 will float and will be assumed to be very high quality coal such as coking coal. Pieces which sink at a specific gravity of 1.80 may be considered to be predominantly refuse. Pieces between 1.50 and 1.80 specific gravity may be considered to be of intermediate quality used as fuel in boilers for example.

The cost of magnetite for heavy media separation is significant and it is desirable to recover the magnetite to the greatest possible extent. In the operation of a heavy media separation plant, the particles discharged from the heavy media vessels carry significant quantities of magnetite from the vessels by Surface adhesion to the solid particles. The particles are passed over screens where they are washed to remove the magnetite and are then moved to storage silos or the like. The magnetite and wash water are passed through magnetic separators where the magnetite is removed to the greatest extent possible and is returned to the heavy media vessel, retaining its original characteristics.

U.S. Pat. No. 3,023,893 discloses the use of a magnetic separator to recover magnetizable particles from water. U.S. Pat. No. 4,921,597 discloses another magnetic separator which effectively separates fine particles of magnetite from water. The magnetic separator includes a drum which rotates counter to flow of water past the drum. Magnets provided within the drum attract magnetite in the water to the drum.

The use of hydrocyclones is also well known in the coal preparation art. For example, U.S. Pat. No. 2,817,441 discloses the use of a hydrocyclone to separate particles into fractions. A hydrocyclone typically comprises a cylindrical chamber which tapers towards one end. One or more feed passages lead tangentially into the chamber near its wider end. An apex aperture is provided at the apex of the chamber, and an overflow aperture is provided at the wider end of the chamber. The chamber may comprise conjoined cylindrical and conical portions and the tapering wall may conform to the wall of the true cone or may be slightly curved to present a concave or convex surface to the inside of the chamber. In conventional designs, the overflow aperture may be defined by a short conduit known as a vortex finder extending axially into the wider end of the chamber. The dimensions of the hydrocyclone and the diameters of the feed aperture and outlets are such that when a liquid is continuously introduced into the feed conduit at a sufficiently high pressure, a rotary current is generated in the chamber having an inner vortex directed towards the vortex finder and an outer vortex which moves axially in the opposite direction. The inner vortex includes an air core, provided there is no back pressure on the outlets. Typical hydrocyclone chambers are generally conical, having a mean angle of taper of from about 5° to 30°, or more. While conventional hydrocyclones are effective at separating relatively small parties on the order of one inch or smaller, they have not gained use for separating larger particles on the order of 3 or 4 inches.

Each of the above-noted U.S. patents is incorporated herein by reference.

SUMMARY OF THE INVENTION

I provide a method of preparing coal which is highly efficient and which provides the capability of high capacity processing. The method preferably provides the ability to handle large pieces of coal up to about 4 inches. The method preferably provides high coal processing rates of up to about 500 tons per hour in high-capacity, high-efficiency single units.

According to one aspect of the invention, I provide a method of preparing coal including the steps of screening run of mine coal to remove oversize refuse, adding magnetizable particles to water to form a slurry, admixing the screened coal with the slurry, delivering the mixture to a hydrocyclone having an outlet for a high specific gravity refuse fraction and an outlet for a low specific gravity clean coal fraction, separating the high specific gravity refuse fraction into a small particle-size fraction and a large particle-size fraction, delivering the small particle-size refuse fraction to a first magnetic separator in which the magnetizable particles are extracted from the small particle-size refuse fraction, separating the low specific gravity clean coal fraction into a small particle-size fraction and a large particle-size fraction, drying the large particle-size clean coal fraction, delivering the small particle-size clean coal fraction to a second magnetic separator in which the magnetizable particles are extracted from the small particle-size clean coal fraction, and drying the small particle-size clean coal fraction.

DETAILED DESCRIPTION OF THE PREFERRED EMBODIMENTS

Figure 1:
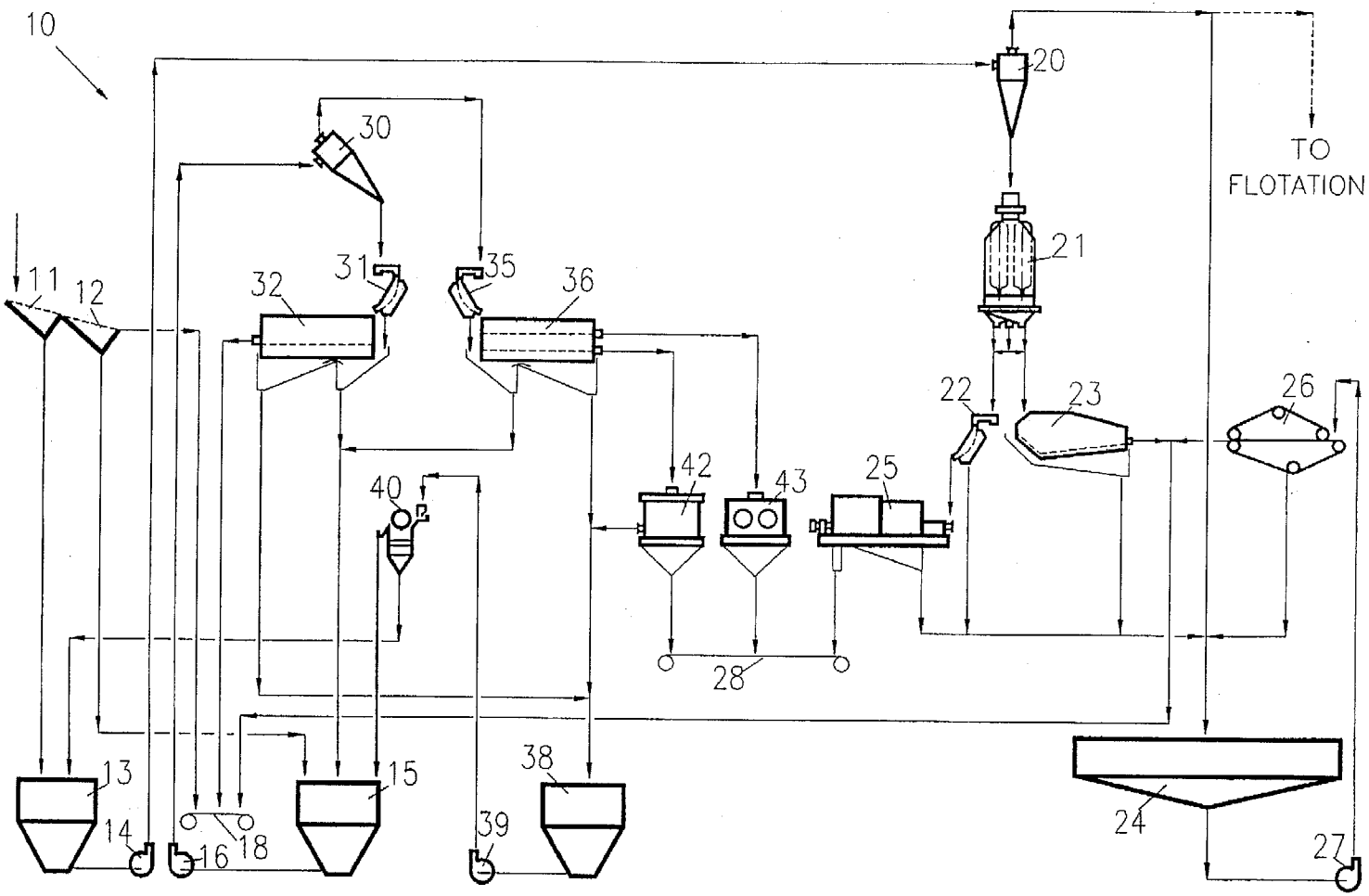
FIG. 1 PRIOR ART
FIG. 1 is a schematic illustration of a conventional coal processing plant.

Referring to the figures, wherein like reference numbers represent like elements throughout the several drawings, FIG. 1 schematically illustrates a conventional coal processing plant 10 for intermediate to fine size coal fractions of less than 0.5 or 1 inch. Run of mine coal is separated into a large particle-size fraction and a smaller particle size fraction, and the smaller particle fraction size is delivered to a desliming screen 11 where fines are partially removed by a water wash. The large particle-size fraction is processed in a separate apparatus (not shown). Overflow from the desliming screen 11 travels to a scalping screen 12. Alternatively, scalping may occur prior to desliming in some conventional systems. The fines and wash water which pass through the desliming screen 11 are delivered to a tank 13. A pump 14 is used to deliver the aqueous mixture of fines from the tank 13 to a sizing hydrocyclone 20. The fraction which passes through the overflow aperture of the sizing hydrocyclone 20 flows to a thickener 24 or, optionally, to flotation. The fraction discharged from the apex aperture of the sizing hydrocyclone 20 travels to conventional spirals 21 which direct the fraction to either a sieve bend 22 or a dewatering screen 23. The spirals may comprise a single bank of triple start spirals one meter in diameter. The fraction which passes through the sieve bend 22 travels to the thickener 24, while the overflow fraction from the sieve bend 22 is delivered to a dryer 25. Once dried, this fraction is delivered to a clean coal conveyor 28. The fraction passing through the dewatering screen 23 travels to the thickener 24, while the overflow fraction from the dewatering screen 23 passes to a refuse conveyor 18. A pump 27 may be used to transport material from the thickener 24 to a belt press 26. Solid material recovered from the belt press 26 is transported to the refuse conveyor 18, while the predominantly liquid fraction passes back to the thickener 24.

Oversize pieces which do not pass through the scalping screen 12 are discarded to the refuse conveyor 18. The particles which pass through the scalping screen 12, typically having a maximum particle size of 0.5 or 1 inch, are delivered to a tank 15 where they are mixed with a slurry of magnetite and water. A pump 16 is used to deliver the aqueous mixture to the feed passage of a hydrocyclone 30. In accordance with conventional operation, the high specific gravity fraction which exits the apex aperture of the cyclone 30 is delivered to a sieve bend 31 and a single deck horizontal vibrating rinse screen 32. The liquid fraction which passes through the sieve bend 31 is delivered to the tank 15 for recirculation to the hydrocyclone 30. Oversize particles which do not pass through the rinse screen 32 are delivered to the refuse conveyor 18. Refuse particles which pass through the rinse screen 32 are delivered to a tank 38. The low specific gravity fraction which exits the overflow aperture of the hydrocyclone 30 is delivered to a sieve bend 35 and a double deck horizontal vibrating rinse screen 36. The liquid fraction which passes through the sieve bend 35 flows to the tank 15, while the remainder is delivered to the rinse screen 36. Oversize particles which do not pass through an upper portion of the rinse screen 36 travel to a crusher 43 to reduce the size of the particles to the desired level. The crushed particles are then discharged from the crusher 43 onto a clean coal conveyor 28. Particles which pass through the upper portion but which do not pass through the lower portion of the rinse screen 36 travel to a dryer 42, from which the dried particles are discharged onto the clean coal conveyor 28. The clean coal fraction which passes through both the upper and lower levels of the rinse screen 36 is delivered to the tank 38, which is the same tank used for storing the refuse fraction which passes through the rinse screen 32. A pump 39 is used to transport the liquid fraction in tank 38 to a magnetic separator 40 in order to remove magnetite from the water and particles. In this manner, the magnetite is recovered from both the refuse and clean coal fractions and recirculated into the system. In accordance with conventional designs, the refuse fraction from the rinse screen 32 and the clean coal fraction from the rinse screen 36 are both delivered to the same magnetic separator 40. This represents a major disadvantage because the clean coal fraction is contaminated by the refuse fraction.

Figure 2:
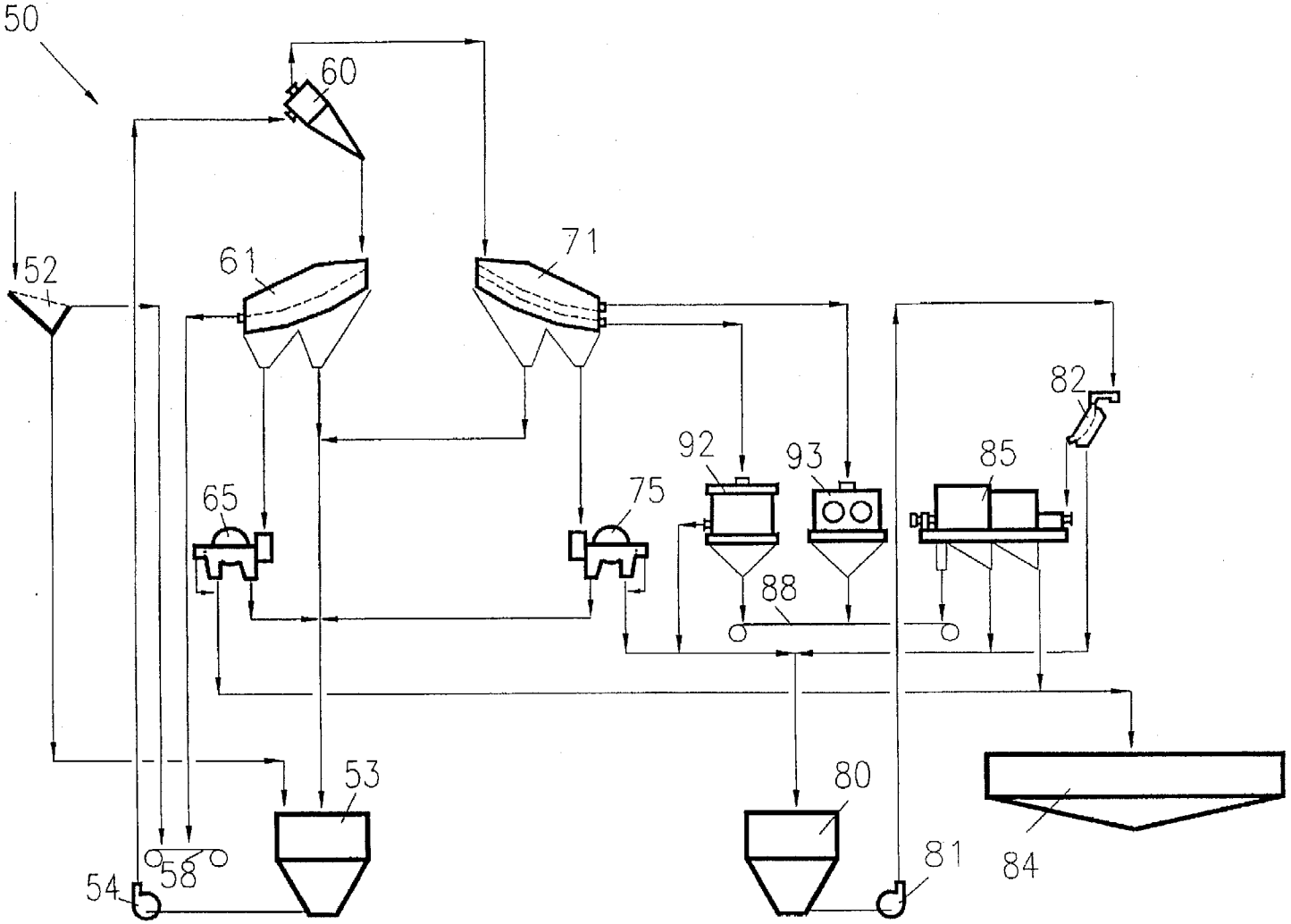
FIG. 2 is a schematic illustration of a coal preparation plant in accordance with an embodiment of the present invention.

FIG. 2 schematically illustrates a coal preparation system 50 in accordance with an embodiment of the present invention. Run of mine coal is delivered to a scalping screen 52, which preferably comprises a conventional banana screen. As used herein the term "banana screen" means a multi-sloped variable bed depth screen. Such banana screens are commercially available from companies such as Allis Mineral Systems and Honert Vibration Technic. Oversize pieces which do not pass through the scalping screen 52 are delivered to a refuse conveyor 58. The oversize refuse is typically greater than about 4 inches in diameter. Particles which pass through the scalping screen 52 are delivered to a heavy media cyclone sump 53 where they are mixed with a slurry comprising water and magnetizable particles such as magnetite. A pump 54 is used transport the aqueous particle mixture from the heavy media cyclone sump 53 to a hydrocyclone 60 which separates the particles into a high specific gravity fraction comprising refuse particles and a low specific gravity fraction comprising clean coal. The specific gravity of the fractions can vary depending on the type of coal being processed and the final quality desired. For most operations, the cut-off between the high and low specific gravity fractions is from about 1.35 to about 1.8. The high specific gravity fraction passes through the apex aperture of the hydrocyclone 60, while the low specific gravity fraction passes through the overflow aperture of the hydrocyclone 60.

The hydrocyclone 60 preferably has a relatively large diameter, e.g., from about 0.8 to about 1.2 meters. The axial length of the hydrocyclone 60 is preferably extended to provide a cylindrical section in the area of the input feed passage which is connected to the tapered conical section. The axial length of the cylindrical section is preferably greater than about 4 times the diameter of the largest particle being fed to the hydrocyclone. In addition, the hydrocyclone 60 preferably includes an extended vortex finder which extends axially from the wider end of the hydrocyclone towards the apex. The extended length of the cylindrical section increases particle retention time in the hydrocyclone, which allows the separation of lower and higher gravity fractions over the full range of particle sizes introduced into the hydrocyclone. This allows the hydrocyclone 60 to process relatively large particle sizes of up to 3 or 4 inches or more.

The high specific gravity fraction which exits the apex aperture of the hydrocyclone 60 is delivered to a drain portion of a refuse drain and rinse screen 61. The refuse drain and rinse screen 61 preferably comprises a single deck vibrating screen, most preferably a banana screen. The liquid portion passing through the drain portion of the refuse drain and rinse screen 61 flows to the heavy media cyclone sump 53 for recirculation to the hydrocyclone 60. The remaining portion travels to a separator portion of the refuse drain and rinse screen 61. Typically, particles having sizes greater than about 0.25 to about 2 mm, and more typically from about 0.5 to about 1 mm are retained on the screen 61. Particles which do not pass through the refuse drain and rinse screen 61 are delivered to the refuse conveyor 58. The material comprising fine refuse particles, water and magnetite particles which passes through the refuse drain and rinse screen 61 is delivered to a first magnetic separator 65. The first magnetic separator 65 is preferably as described in U.S. Pat. No. 4,921,597. The magnetizable particles which are removed by the first magnetic separator 65 are delivered to the heavy media cyclone sump 53. Upon separation of the magnetizable particles, the remaining liquid fraction is discharged from the first magnetic separator 65 to a thickener 84.

The low specific gravity fraction which exits the overflow aperture of the hydrocyclone 60 is delivered to a drain portion of a clean coal drain and rinse screen 71. The clean coal drain and rinse screen 71 preferably comprises a double deck vibrating screen, most preferably a banana screen. The liquid fraction which passes through the clean coal drain and rinse screen 71 flows to the heavy media cyclone sump 53. The remaining portion travels to a separator portion of the clean coal drain and rinse screen 71 which preferably includes an upper screen and a lower screen. The clean coal drain and rinse screen 71 separates the low specific gravity fraction into a small particle-size clean coal fraction and a large particle-size clean coal fraction. Oversize particles which do not pass through the upper level of the clean coal drain and rinse screen 71 are delivered to a conventional crusher 93, which comminutes the oversize clean coal particles to the desired size. The comminuted clean coal particles are then discharged from the crusher 93 onto a clean coal conveyor 88. Particles which pass through the upper portion but which do not pass through the lower portion of the clean coal drain and rinse screen 71 are delivered to a commercially available centrifugal dryer 92 to reduce the water content of the clean coal. In typical operations these particles will have a minimum particle size of from about 0.25 to about 2 mm, more typically from about 0.5 to about 1 mm. The dried clean coal is then discharged from the centrifugal dryer 92 onto the clean coal conveyor 88.

The small particle-size clean coal fraction which passes through both levels of the clean coal drain and rinse screen 71 is delivered to a second magnetic separator 75. This fraction typically has a maximum particle size of from about 0.25 to about 2 mm, more typically from about 0.5 to about 1 mm. The second magnetic separator 75 is preferably as described in U.S. Pat. No. 4,921,597. Magnetizable particles which are removed from the water and small particle-size clean coal fraction are delivered from the second magnetic separator 75 to the heavy media cyclone sump 53. The remaining small particle-size clean coal fraction is then discharged from the second magnetic separator 75 to a clean coal tailings sump 80. A pump 81 is used to deliver the small particle-size clean coal fraction to a conventional sieve bend 82 comprising a screen with radially spaced openings. The portion which passes through the sieve bend 82 travels back to the clean coal tailings sump 80 for recirculation. The remainder of the material which does not pass through the sieve bend 82 is delivered to a commercially available screen bowl centrifugal dryer 85. In a first drying stage, liquid is discharged from the dryer 85 to the thickener 84. In a second drying stage, water and entrained clean coal particles are discharged from the dryer 85 to the clean coal tailing sump 80 for recirculation to the sieve bend 82. In a final stage, the dried small particle-size clean coal fraction is discharged from the dryer 85 to the clean coal conveyor 88.

Figure 3:
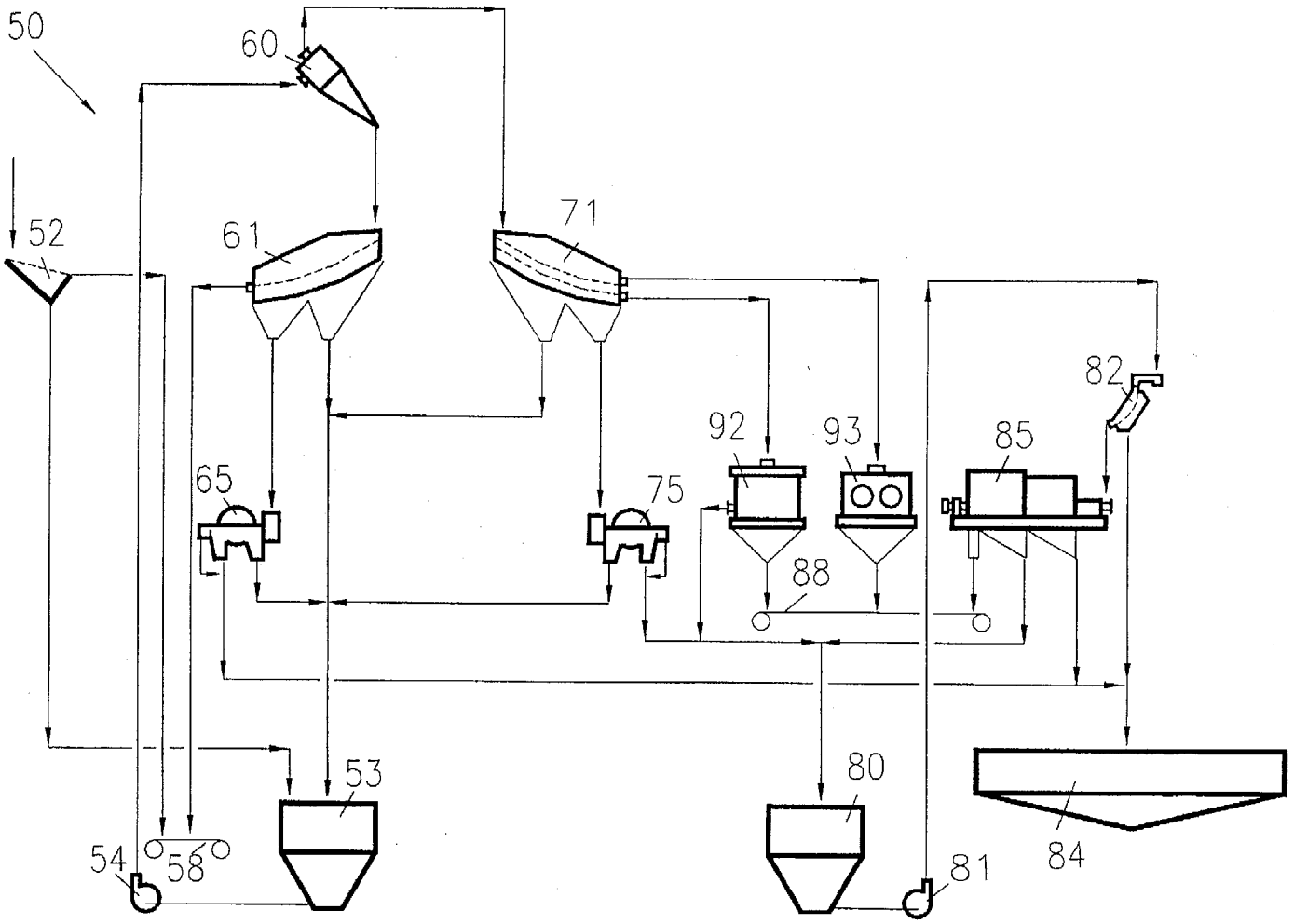
FIG. 3 is a schematic illustration of a coal preparation plant in accordance with another embodiment of the present invention.

FIG. 3 schematically illustrates a coal preparation system 50 in accordance with an embodiment of the present invention similar to that shown in FIG. 2, with certain variations. In the embodiment of FIG. 3, the liquid fraction which passes through the sieve bend 82 is delivered directly to the thickener 84 instead of the clean coal tailings sump 80. Thus, once the small particle-size clean coal fraction is passed through the sieve bend 82, it is not recirculated through the tailings sump 80, but is rather discarded to the thickener 84.

Figure 4:
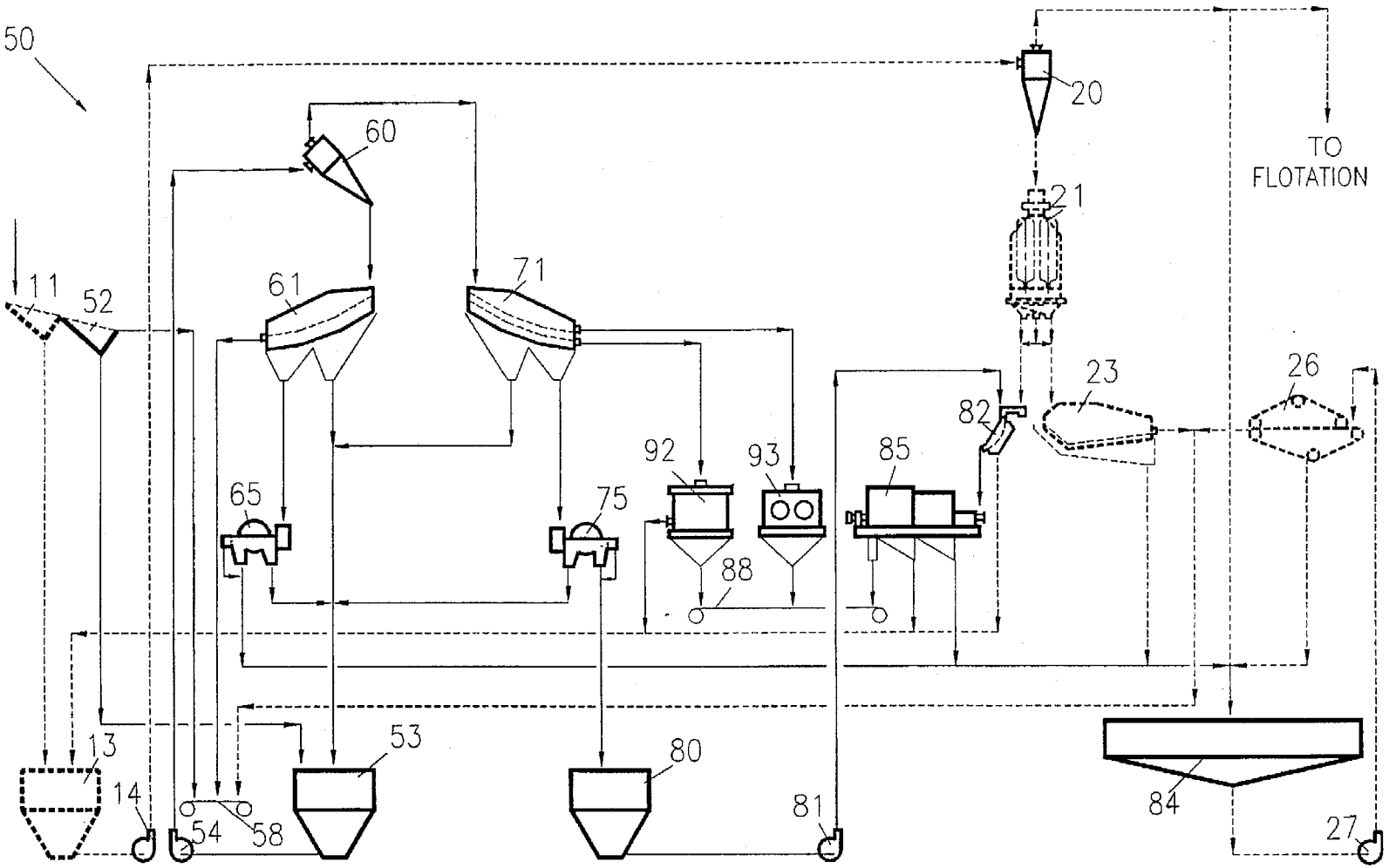
FIG. 4 is a schematic illustration of a coal preparation plant in accordance with a further embodiment of the present invention.

FIG. 4 schematically illustrates a coal preparation system 50 in accordance with another embodiment of the present invention. In this embodiment, a system similar to that shown in FIGS. 2 and 3 is combined with certain features of the system of FIG. 1, which are generally shown with broken lines. In addition to the scalping screen 52, the run of mine coal is first delivered to a desliming screen 11 to remove fines, e.g., particle sizes of less than about 1 mm. Overflow from the desliming screen 11 travels to the scalping screen 52. As with the embodiments of FIGS. 2 and 3, the scalping screen 52 separates oversize refuse pieces and allows undersize particles to pass through the screen. The particles which pass through the scalping screen 52 may then be treated in the same manner as the embodiments of FIGS. 2 and 3. In addition, the fine particles passing through the desliming screen 11 as shown by the broken fines of FIG. 4 are delivered to a sizing hydrocyclone 20 via a tank 13, in a manner similar to that shown in FIG. 1. The portion which passes through the overflow aperture of the sizing hydrocyclone 20 flows to the thickener 84 or to flotation. The portion discharged from the apex aperture of the sizing hydrocyclone 20 travels to spirals 21 and then to either the sieve bend 82 or the dewatering screen 23. The fraction which does not pass through the sieve bend 82 is delivered to the dryer 85 along with the overflow from the clean coal tailings sump 80. The dried clean coal fraction is then discharged from the dryer 85 to the clean coal conveyor 88.

Figure 5:
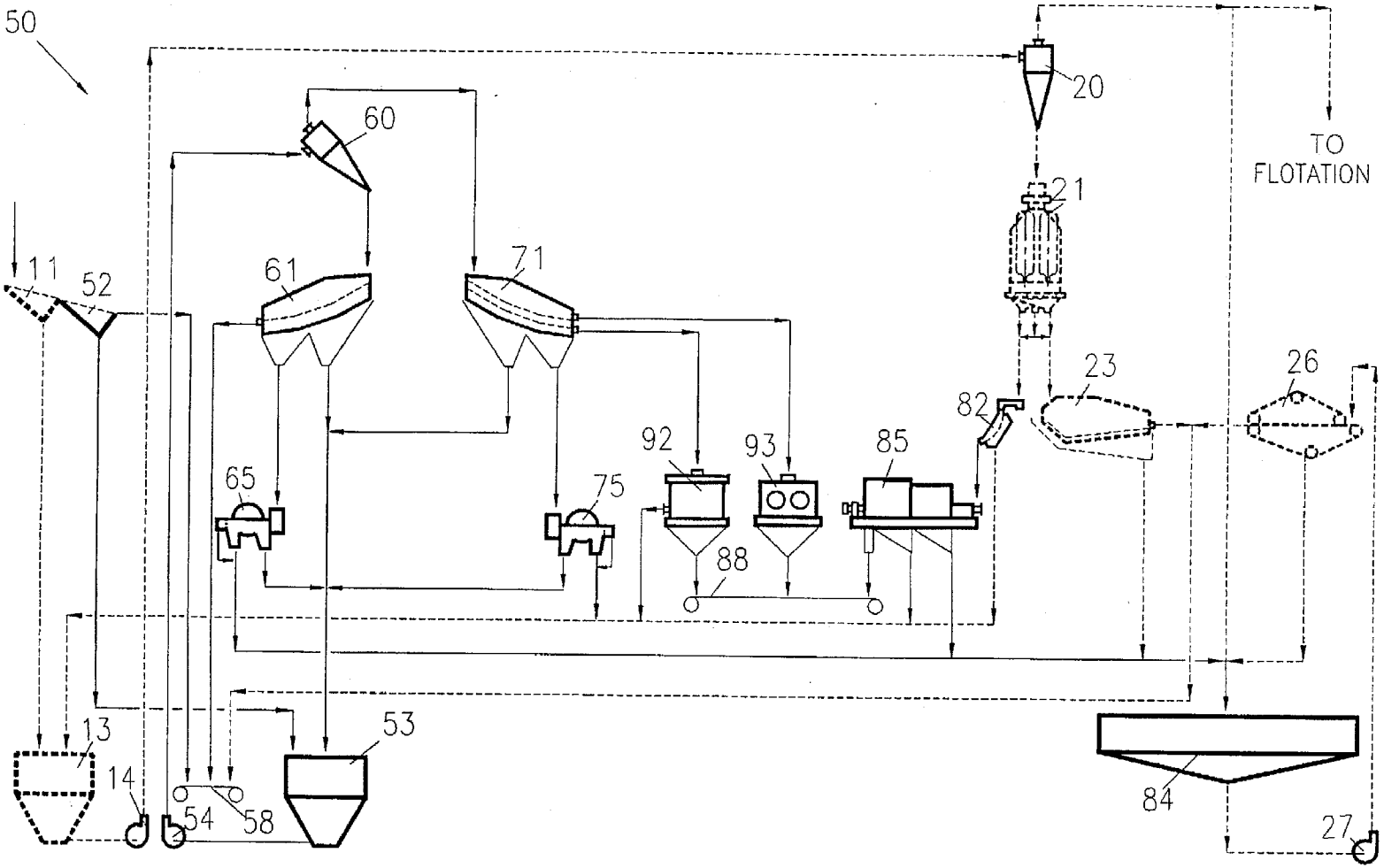
FIG. 5 is a schematic illustration of a coal preparation plant in accordance with another embodiment of the present invention.

FIG. 5 schematically illustrates a further embodiment of the present invention similar to that shown in FIG. 4, with certain variations. In the embodiment of FIG. 5, the second magnetic separator 75 does not discharge to a clean coal tailings sump 80 as shown in FIG. 4, but rather discharges to the tank 13. In this manner, after the magnetizable particles are removed from the small particle-size clean coal fraction, the fraction is delivered to the sizing hydrocyclone 20 and may pass through the apex opening thereof for further processing by the spirals 21.

The method and apparatus of the present invention advantageously use high-capacity, high-efficiency single units of equipment which rely on each other's performance to achieve highly improved overall process capacity and efficiency. The use of large diameter cyclones capable of processing large particles of up to about 4 inches eliminates the necessity of a separate circuit for coarse particles as is typically used in conventional coal processing plants. The use of high efficiency drain and rinse screens allows a single screening unit to perform the function of multiple screens required in prior art plants. The use of separate high capacity, high efficiency magnetic separators for the refuse and clean coal circuits permits the recovery of uncontaminated magnetite in a single pass through, and allows segrated clean coal to be recovered directly from the hydrocyclone as a final product without recirculation through the system. In addition, the present system reduces the requirements for pumps, piping, fixtures, and the like, which reduces costs and maintenance in comparison with conventional plants.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of preparing coal comprising:

screening run of mine coal to remove oversize refuse and to provide screened coal having at least a portion greater than about 1 mm in size;

adding magnetizable particles to water to form a slurry;

admixing the screened coal with the slurry;

delivering the mixture to a hydrocyclone having an outlet for a high specific gravity fraction comprising refuse particles and an outlet for a low specific gravity fraction comprising clean coal;

separating the high specific gravity fraction into a small particle-size refuse fraction and a large particle-size refuse fraction;

discarding the large particle-size refuse fraction;

delivering the small particle-size refuse fraction to a first magnetic separator;

extracting the magnetizable particles from the small particle-size refuse fraction within the first magnetic separator;

discarding the small particle-size refuse fraction from which the magnetizable particles have been extracted;

separating the low specific gravity fraction into a small particle-size clean coal fraction and a large particle-size clean coal fraction;

drying at least a portion of the large particle-size clean coal fraction;

delivering the small particle-size clean coal fraction to a second magnetic separator;

extracting the magnetizable particles from the small particle-size clean coal fraction within the second magnetic separator; and drying the small particle-size clean coal fraction.

2. The method of claim 1, wherein the run of mine coal is screened with a banana screen to remove oversize refuse.

3. The method of claim 1, further comprising removing fines from the run of mine coal prior to screening.

4. The method of claim 3, wherein the fines are removed from the run of mine coal with a desliming screen.

5. The method of claim 1, wherein the oversize refuse has a size of greater than about 4 inches.

6. The method of claim 1, wherein the magnetizable particles comprise magnetite.

7. The method of claim 1, wherein the high specific gravity fraction is separated into the small particle-size refuse fraction and the large particle-size refuse fraction with a single deck vibrating screen.

8. The method of claim 7, wherein the single deck vibrating screen comprises a banana screen.

9. The method of claim 1, wherein the low specific gravity fraction is separated into the small particle-size clean coal fraction and the large particle-size clean coal fraction with a double deck vibrating screen.

10. The method claim 9, wherein the double deck vibrating screen comprises a banana screen.

11. The method of claim 1, further comprising delivering the small particle-size clean coal fraction to a sieve bend to remove undersize particles prior to drying.

12. The method of claim 1, further comprising separating oversize particles from the large particle-size clean coal fraction prior to drying the large particle-size clean coal fraction.

13. The method of claim 12, further comprising comminuting the oversize particles separated from the large particle-size clean coal fraction to reduce the size thereof.

14. Apparatus for preparing coal comprising:

screen means for screening run of mine coal to remove oversize refuse and to provide screened coal having at least a portion greater than about 1 mm in size;

mixing means for admixing the screened coal with water and magnetizable particles to form a mixture;

hydrocyclone means for separating the mixture into a high specific gravity fraction comprising refuse particles and a low specific gravity fraction comprising clean coal;

high specific gravity fraction separating means for separating the high specific gravity fraction into a small particle-size refuse fraction and a large particle-size refuse fraction;

first magnetic separator means for extracting the magnetizable particles from the small particle-size refuse fraction;

low specific gravity fraction separating means for separating the low specific gravity fraction into a small particle-size clean coal fraction and a large particle-size clean coal fraction;

second magnetic separator means for extracting the magnetizable particles from the small particle-size clean coal fraction; and drying means for drying the small particle-size clean coal fraction and the large particle-size clean coal fraction.

15. The method of claim 1, wherein the hydrocyclone comprises a substantially cylindrical section having a diameter of greater than about 0.8 meters.

16. A method of preparing coal comprising:

screening run of mine coal to remove oversize refuse;

adding magnetizable particles to water to form a slurry;

admixing the screened coal with the slurry;

delivering the mixture to a hydrocyclone having an outlet for a high specific gravity fraction comprising refuse particles and an outlet for a low specific gravity fraction comprising clean coal;

separating the high specific gravity fraction into a small particle-size refuse fraction and a large particle-size refuse fraction;

discarding the large particle-size refuse fraction;

delivering the small particle-size refuse fraction to a first magnetic separator;

extracting the magnetizable particles from the small particle-size refuse fraction within the first magnetic separator;

discarding the small particle-size refuse fraction from which the magnetizable particles have been extracted;

separating the low specific gravity fraction into a small particle-size clean coal fraction and a large particle-size clean coal fraction;

drying at least a portion of the large particle-size clean coal fraction;

delivering the small particle-size clean coal fraction to a second magnetic separator without prior comminution;

extracting the magnetizable particles from the small particle-size clean coal fraction within the second magnetic separator; and drying the small particle-size clean coal fraction.

* * * * *